US009041974B2

(12) United States Patent
Muroi

(10) Patent No.: US 9,041,974 B2
(45) Date of Patent: May 26, 2015

(54) IMAGE FORMING APPARATUS

(71) Applicant: Hideo Muroi, Kanagawa (JP)

(72) Inventor: Hideo Muroi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/275,816

(22) Filed: May 12, 2014

(65) Prior Publication Data

US 2014/0340696 A1 Nov. 20, 2014

(30) Foreign Application Priority Data

May 14, 2013 (JP) ..... 2013-102427

(51) Int. Cl.
*G06K 15/00* (2006.01)
*G03G 15/00* (2006.01)

(52) U.S. Cl.
CPC .... *G03G 15/5058* (2013.01); *G03G 2215/0129* (2013.01); *G03G 2215/0164* (2013.01)

(58) Field of Classification Search
CPC ..... G03G 15/5058; G03G 2215/0129; G03G 2215/0164
USPC ..... 358/1.5, 1.2; 399/15, 49
See application file for complete search history.

(56) References Cited

U.S. PATENT DOCUMENTS

| | | | | |
|---|---|---|---|---|
| 2009/0041486 | A1* | 2/2009 | Yoshioka et al. | 399/49 |
| 2011/0243582 | A1* | 10/2011 | Matsumoto et al. | 399/15 |
| 2012/0315056 | A1 | 12/2012 | Muroi et al. | |
| 2013/0208288 | A1* | 8/2013 | Nagata et al. | 358/1.2 |

FOREIGN PATENT DOCUMENTS

| | | |
|---|---|---|
| JP | 2006-284892 | 10/2006 |
| JP | 2011-109394 | 6/2011 |
| JP | 2011-164240 | 8/2011 |

* cited by examiner

*Primary Examiner* — Ashish K Thomas
*Assistant Examiner* — Bharatkumar Shah
(74) *Attorney, Agent, or Firm* — Duft Bornsen & Fettig LLP

(57) ABSTRACT

An image forming apparatus includes an image carrier, an image forming unit to form a multi-gradation image on the image carrier, a density detector to detect density of the multi-gradation image, a gradation characteristic data generator to generate gradation characteristic data, and a gradation corrector to correct image data of the multi-gradation image. The gradation characteristic data generator forms a gradation correction pattern on the image carrier via the image forming unit. The gradation correction pattern is a continuous gradation pattern including a first pattern having gradation levels from a maximum gradation level to a minimum gradation level and a second pattern having gradation levels from the minimum gradation level to the maximum gradation level. The gradation characteristic data generator continuously detects image density of the gradation correction pattern and background areas next to the gradation correction pattern via the density detector to generate the gradation characteristic data.

7 Claims, 11 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2013-102427, filed on May 14, 2013, in the Japan Patent Office, the entire disclosure of which is hereby incorporated by reference herein.

BACKGROUND

1. Technical Field

Embodiments of this disclosure generally relate to an image forming apparatus capable of forming an image having a plurality of gradation levels.

2. Related Art

Typical image forming apparatuses capable of forming an image having a plurality of gradation levels (hereinafter referred to as a multi-gradation image) generate gradation characteristic data by using a pattern for correcting gradation (hereinafter referred to as a gradation correction pattern). The gradation correction pattern has known gradation levels to perform gradation correction on image data of the multi-gradation image to be outputted, in order to stabilize image density of the multi-gradation image formed on a recording medium.

In such image forming apparatuses, for example, a gradation correction pattern having patches corresponding to a plurality of input gradation levels is formed on an intermediate transfer belt serving as an image carrier. The density of each patch of the gradation correction pattern is detected by a density sensor. According to a detected density of the gradation correction pattern, gradation characteristic data is generated that shows a relation between image density and gradation levels in a gradation range of the multi-gradation image that can be formed. The gradation is corrected upon formation of the multi-gradation image by using the gradation characteristic data.

When the gradation correction pattern having the patches is used, the patches of the gradation correction pattern are selected as appropriate so that the gradation is corrected as appropriate even when the gradation characteristics change significantly due to changes in the environment.

To correct the gradation as appropriate, some typical image forming apparatuses use a continuous gradation pattern as the gradation correction pattern, in which input gradation levels change continuously from a minimum gradation level to a maximum gradation level. In such image forming apparatuses, a density sensor continuously detects density of each portion of the continuous gradation pattern formed on the intermediate transfer belt that rotates at a predetermined speed, in a predetermined sampling period. In addition, an input gradation level of each portion of the continuous gradation pattern is calculated according to the speed at which the intermediate transfer belt rotates, the sampling period, and the length of the continuous gradation pattern formed on the intermediate transfer belt. Gradation characteristic data is generated according to the detected density of each portion of the continuous gradation pattern and calculated input gradation levels.

However, when the continuous gradation pattern is used as the gradation correction pattern, the accuracy of the gradation characteristic data may decrease due to variation in detected input gradation levels at the respective positions of the continuous gradation pattern at which the density is detected. The variation in the detected input gradation levels may be caused by, e.g., variation in the speed at which the intermediate transfer belt serving as an image carrier rotates and/or variation in the length of the continuous gradation pattern formed on the intermediate transfer belt.

SUMMARY

In one embodiment of this disclosure, an improved image forming apparatus includes an image carrier, an image forming unit, a density detector, a gradation characteristic data generator, and a gradation corrector. The image carrier is rotatable at a predetermined speed to carry an image on a surface thereof. The image forming unit forms a multi-gradation image on the image carrier. The density detector detects density of the multi-gradation image formed on the image carrier. The gradation characteristic data generator forms a gradation correction pattern on the image carrier via the image forming unit and detects image density of the gradation correction pattern via the density detector to generate gradation characteristic data that shows a relation between the image density and a plurality of gradation levels in a gradation range used for forming the multi-gradation image according to a detected image density of the gradation correction pattern. The gradation corrector corrects image data of the multi-gradation image to be outputted, according to the gradation characteristic data. The gradation correction pattern is a continuous gradation pattern including a first pattern and a second pattern. The first pattern has gradation levels changing continuously from a maximum gradation level to a minimum gradation level in the gradation range. The second pattern has gradation levels changing continuously from the minimum gradation level to the maximum gradation level in the gradation range. The second pattern is continuous with the first pattern in the direction in which the image carrier rotates.

The gradation characteristic data generator continuously detects image density of the continuous gradation pattern formed on the image carrier and image density of background areas next to an upstream end and a downstream end of the gradation correction pattern, respectively, in a direction in which the image carrier rotates, in a predetermined sampling period, via the density detector, to generate the gradation characteristic data according to detected image density of the continuous gradation pattern and image density of the background areas.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
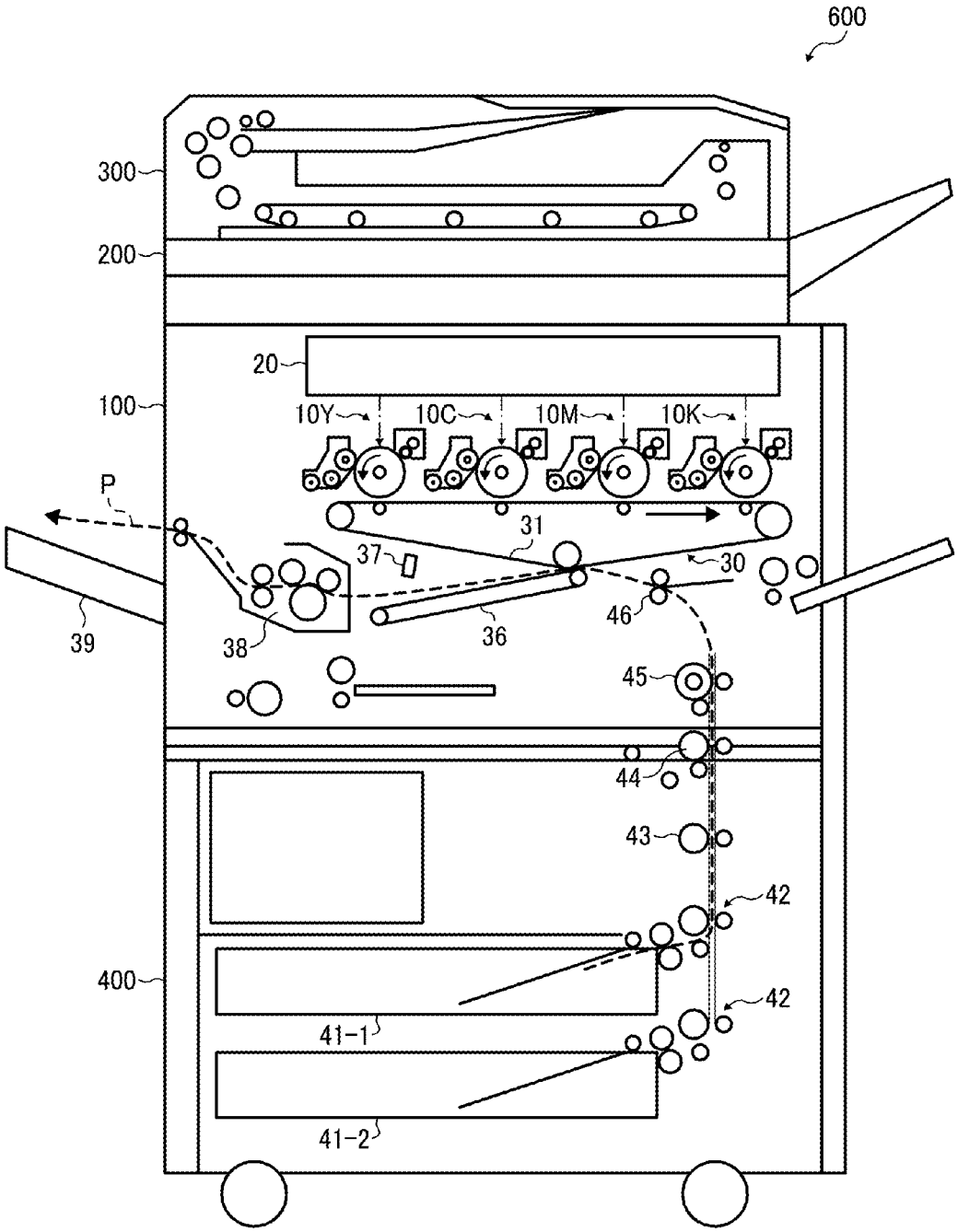
FIG. 1 is a schematic overall view of an image forming apparatus according to an embodiment of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals will be given to identical or corresponding constituent elements such as parts and materials having the same functions, and redundant descriptions thereof will be omitted unless otherwise required.

Referring now to the drawings, wherein like reference numerals designate identical or corresponding parts throughout the several views, embodiments of this disclosure are described below.

Figure 2:
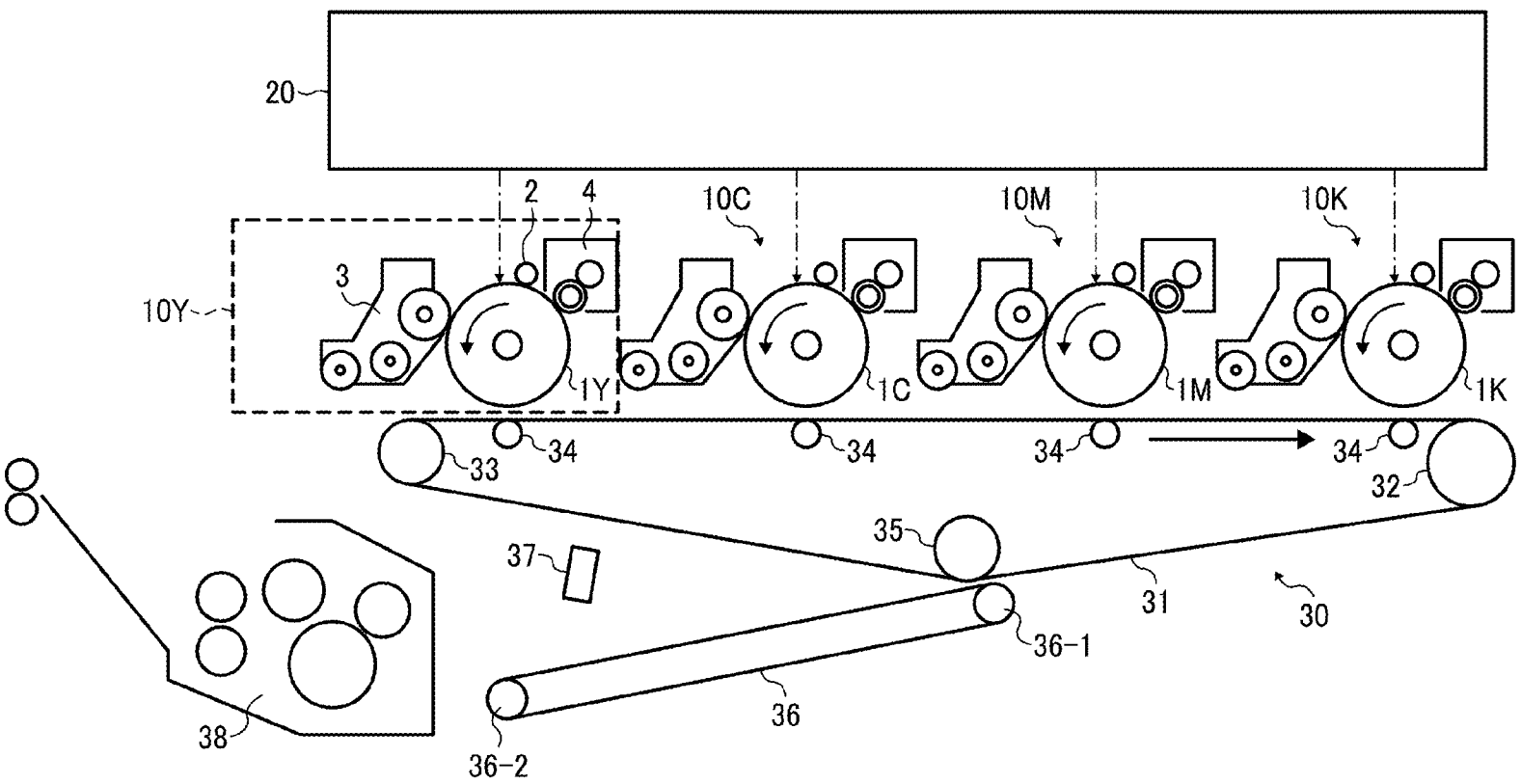
FIG. 2 is a partially enlarged view of the image forming apparatus of FIG. 1.

Initially with reference to FIGS. 1 and 2, a description is given of an image forming apparatus 600 according to an embodiment of this disclosure.

FIG. 1 is a schematic overall view of the image forming apparatus 600 according to the embodiment of this disclosure. FIG. 2 is a partially enlarged view of the image forming apparatus 600. The image forming apparatus 600 includes, e.g., an image forming unit 100, a sheet feeding unit 400 serving as a recording medium supplier, an image scanner 200, an automatic document feeder 300 serving as an original-document supplier. The image forming unit 100 forms an image on a recording medium such as a recording sheet. The sheet feeding unit 400 supplies the recording medium such as a recording sheet to the image forming unit 100. The image scanner 200 scans an image of an original document. The automatic document feeder 300 automatically supplies the original document to the image scanner 200.

A transfer unit 30 is disposed in a housing of the image forming apparatus 600. As illustrated in FIG. 2, the transfer unit 30 includes an endless intermediate transfer belt 31 serving as an image carrier (or intermediate transfer body), and a plurality of rollers around which the intermediate transfer belt 31 is stretched. Specifically, the plurality of rollers include, e.g., a drive roller 32 rotated by a drive device, a driven roller 33, and a secondary-transfer backup roller 35. The intermediate transfer belt 31 is made of, e.g., a resin material having low stretchability, such as polyimide, in which carbon powder is dispersed to adjust electrical resistance. The endless intermediate transfer belt 31 is moved by rotation of the drive roller 32 while being stretched over the drive roller 32, the secondary-transfer backup roller 35, the driven roller 33 and four primary-transfer rollers 34. The four primary-transfer rollers 34 are used when toner images of yellow (Y), cyan (C), magenta (M) and black (K) formed on photoconductors 1Y, 1C, 1M, and 1K serving as image carriers (or latent image carriers), respectively, are transferred onto the intermediate transfer belt 31.

An optical writing unit 20 serving as an optical writer is disposed above four process units 10Y, 10C, 10M, and 10K. In the optical writing unit 20, a laser controller drives four laser diodes (LDs) serving as light sources according to image data of, e.g., an input image to be outputted later. Thus, the optical writing unit 20 emits four writing light beams. The four process units 10Y, 10C, 10M, and 10K includes the drum-shaped photoconductors 1Y, 1C, 1M, and 1K serving as latent image carriers, respectively. The optical writing unit 20 irradiates the photoconductors 1Y, 1C, 1M, and 1K with the four writing light beams, respectively, in the dark. Accordingly, electrostatic images are formed on surfaces of the photoconductors 1Y, 1C, 1M, and 1K, respectively.

The optical writing unit 20 according to this embodiment includes, e.g., the laser diodes (LDs) serving as light sources, light deflectors such as polygon mirrors, reflection mirrors and optical lenses. In the optical writing unit 20, laser beams (or writing light beams) emitted by the laser diodes are deflected by the light deflectors, reflected by the reflection mirrors and pass through the optical lenses to finally reach the surfaces of the photoconductors 1Y, 1C, 1M, and 1K. Thus, the surfaces of the photoconductors 1Y, 1C, 1M, and 1K are irradiated with the writing light beams. Alternatively, the optical writing unit 20 may include a light emitting diode (LED) array serving as a light source.

The four process units 10Y, 10C, 10M, and 10K have identical configurations, differing only in their developing colors, that is, colors of toner images formed in a development process. Each of the four process units 10Y, 10C, 10M, and 10K is surrounded by, e.g., a charging unit 2 serving as a charger, a developing unit 3, and a cleaning unit 4. The charging units 2 charge the respective surfaces of the photoconductors 1Y, 1C, 1M, and 1K before the respective surfaces of the photoconductors 1Y, 1C, 1M, and 1K are irradiated with the writing light beams. The developing units 3 develop the respective electrostatic latent images formed on the surfaces of the photoconductors 1Y, 1C, 1M, and 1K with toner of the respective colors, namely, yellow, cyan, magenta, and black. The cleaning units 4 clean the respective surfaces of the photoconductors 1Y, 1C, 1M, and 1K after a primary-transfer process.

The electrostatic latent images formed on the respective surfaces of the photoconductors 1Y, 1C, 1M, and 1K in an exposure process performed by the optical writing unit 20 are developed in the development process, in which toner of yellow, cyan, magenta, and black accommodated in the respective developing units 3 electrostatically adhere to the respective surfaces of the photoconductors 1Y, 1C, 1M, and 1K. Thus, visible images, also known as toner images, of the colors of yellow, cyan, magenta, and black are formed on the surfaces of the photoconductors 1Y, 1C, 1M, and 1K, respectively. Then, the toner images formed on the surfaces of the photoconductors 1Y, 1C, 1M, and 1K are sequentially transferred onto the intermediate transfer belt 31 while being superimposed one atop another. Accordingly, a desired full-color toner image is formed on the intermediate transfer belt 31.

Referring back to FIG. 1, the sheet feeding unit 400 includes, e.g., a plurality of sheet trays 41-1 and 41-2 and a sheet feeding device 42. The recording medium such as a recording sheet is fed from one of the sheet trays 41-1 and 41-2 by the sheet feeding device 42. The recording medium is then conveyed to a pair of registration rollers 46 via conveyor rollers 43 through 45. In a predetermined timing, the recording medium is conveyed to a secondary-transfer nip formed between the secondary-transfer backup roller 35 and a roller 36-1 facing the secondary-transfer backup roller 35. As illustrated in FIG. 2, the roller 36-1 is disposed in a loop defined by a conveyor belt 36, together with a roller 36-2. The secondary-transfer backup roller 35 and the roller 36-1 constitute a secondary-transfer unit. While the recording medium passes through the secondary-transfer nip along with the conveyor belt 36, the full-color toner image formed on the intermediate transfer belt 31 is transferred onto the recording medium. Specifically, the four color toner images superimposed one atop another on the intermediate transfer belt 31 are transferred onto the recording medium at once. Then, the recording medium carrying the full-color toner image thereon passes through a fixing unit 38, in which the full-color toner image is fixed onto the recording medium to be a color print image. Finally, the recording medium is discharged onto an output tray 39 provided outside a body of the image forming apparatus 600.

The image forming apparatus 600 also includes a controller 611 implemented as a central processing unit (CPU) such as a microprocessor to perform various types of control described later, and provided with control circuits, an input/output device, a clock, a timer, and a storage unit including a nonvolatile memory and a volatile memory. The storage unit of the controller 611 stores various types of control programs and information such as outputs from sensors and results of correction control.

The controller 611 also serves as a gradation characteristic data generator to generate gradation characteristic data that shows a relation between image density and a plurality of gradation levels in a gradation range used for forming a multi-gradation image. In such a case, the controller 611 forms a gradation correction pattern on an image carrier such as the intermediate transfer belt 31 via the image forming unit 100. The controller 611 also detects image density of the gradation correction pattern via a density sensor array 37. According to a detected image density of the gradation correction pattern, the controller 611 generates the gradation characteristic data. A detailed description is given later of generation of the gradation characteristic data.

Figure 3:
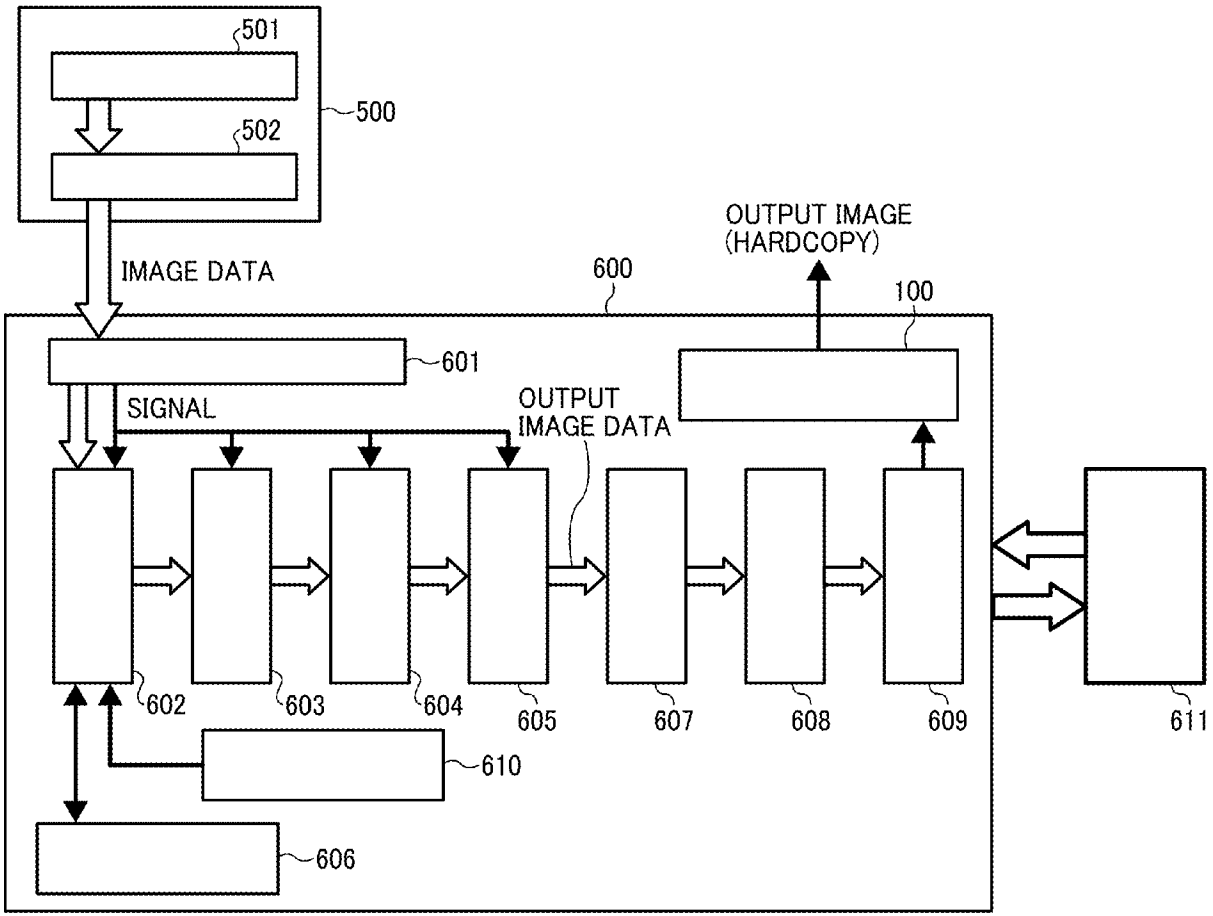
FIG. 3 is a diagram of a flow of image data processing in the image forming apparatus of FIG. 1.

Referring now to FIG. 3, a description is given of image data processing of an image to be outputted, that is, an image to be formed, in the image forming apparatus 600 described above. Specifically, a description is given of the image data processing starting from image processing and signal processing of image data of an input image to generate a laser drive signal to be transmitted to the optical writing unit 20.

FIG. 3 is a diagram of a flow of the image data processing in the image forming apparatus 600.

Firstly, image data is inputted to the image forming apparatus 600 illustrated in FIG. 1 from application software 501 on an external host computer 500 via a printer driver 502. At this time, the image data is converted to page description language (PDL) by the printer driver 502. When the image data described in the PDL is inputted as input data to a rasterization unit 601, the rasterization unit 601 interprets the input data and forms a rasterized image from the input data. At this time, signals showing types and attribution of, e.g., characters, lines, photographs, and graphic images are generated for each object. The signals are transmitted to, e.g., an input/output characteristic correction unit 602, a modulation transfer function filtering unit 603 (hereinafter simply referred to as MTF filtering unit 603), a color correction and gradation correction unit 604 (hereinafter simply referred to as color/gradation correction unit 604), and a pseudo halftone processing unit 605.

In the input/output characteristic correction unit 602, gradation levels in the rasterized image are corrected to obtain desired characteristics according to an input/output characteristic correction signal. The input/output characteristic correction unit 602 uses an output of the density sensor array 37 received from a density sensor output unit 610 while giving and receiving information to and from a storage unit 606 constituted of a nonvolatile memory and a volatile memory, thereby forming the input/output characteristic correction signal and performing correction. The input/output characteristic correction signal thus formed is stored in the nonvolatile memory of the storage unit 606 to be used for subsequent image formation.

The MTF filtering unit 603 selects a most suitable filter for each attribution according to the signal transmitted from the rasterization unit 601, thereby performing an enhancement process. In this embodiment, a typical MTF filtering process is employed, therefore a detailed description of the MTF filtering process is omitted. The image data is transmitted to the color/gradation correction unit 604 after the MTF filtering process in the MTF filtering unit 603.

The color/gradation correction unit 604 performs various correction processes, such as a color correction process and a gradation correction process described below. In the correction process, a red-green-blue (RGB) color space, that is, a PDL color space, inputted from the host computer 500, is converted to a color space of the colors of toner used in the image forming unit 100, and more specifically, to a cyan-magenta-yellow-black (CMYK) color space. The color correction process is performed according to the signal transmitted from the rasterization unit 601 by using an optimum color correction coefficient for each attribution. The gradation correction process is performed to correct the image data of the multi-gradation image to be outputted, according to gradation characteristic data generated by using a gradation correction pattern described later. Thus, the color/gradation correction unit 604 serves as a gradation corrector to correct image data of a multi-gradation image to be outputted according to gradation characteristic data. It is to be noted that, in this embodiment, a typical color/gradation correction process can be employed, therefore a detailed description of the color/gradation correction process is omitted.

The image data is then transmitted from the color/gradation correction unit 604 to the pseudo halftone processing unit 605. The pseudo halftone processing unit 605 performs a pseudo halftone process to generate an output image data. For example, the pseudo halftone process is performed by employing dithering on the data after the color/gradation correction process. In short, quantization is performed by comparison with a dithering matrix stored in advance.

The output image data is then transmitted from the pseudo halftone processing unit 605 to a video signal processing unit 607. The video signal processing unit 607 converts the output image data to a video signal. Then, the video signal is transmitted to a pulse width modulation signal generating unit 608 (hereinafter referred to as PWM signal generating unit 608). The PWM signal generating unit 608 generates a PWM signal as a light source control signal according to the video signal. Then, the PWM signal is transmitted to a laser diode drive unit 609 (hereinafter referred to as LD drive unit 609). The LD drive unit 609 generates a laser diode (LD) drive signal according to the PWM signal. The laser diodes (LDs) as light sources incorporated in the optical writing unit 20 are driven according to the LD drive signal.

Figure 4A:
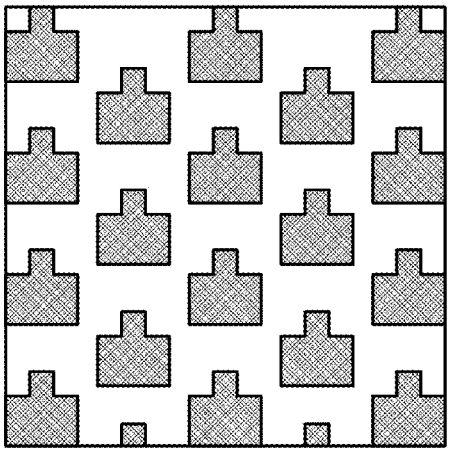
FIG. 4A is a schematic view of a dot-like area coverage modulation pattern that constitutes a gradation pattern.
Figure 4B:
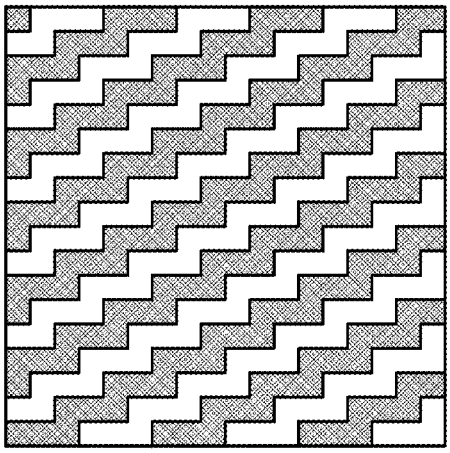
FIG. 4B is a schematic view of a linear area coverage modulation pattern that constitutes a gradation pattern.

Referring now to FIGS. 4A and 4B, a description is given of area coverage modulation patterns.

FIG. 4A is a schematic view of a dot-like area coverage modulation pattern that constitutes a gradation pattern described later. FIG. 4B is a schematic view of a linear area coverage modulation pattern that constitutes a gradation pattern described later. According to the signal transmitted from the rasterization unit 601, a dithering matrix having an optimum number of lines and screen angle is selected for a most suitable pseudo halftone process.

Figure 5A:
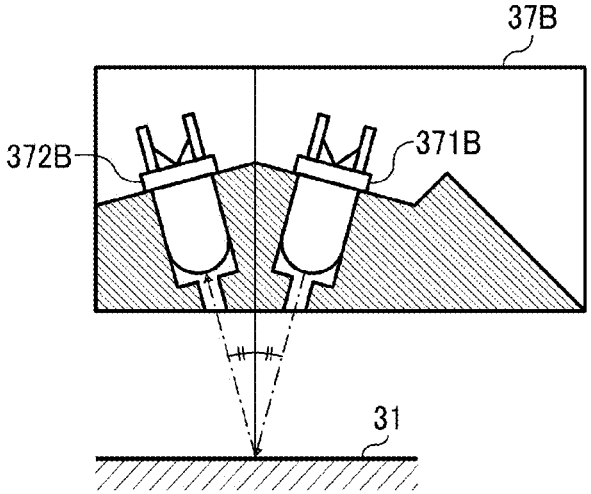
FIG. 5A is a schematic view of a density sensor.
Figure 5B:
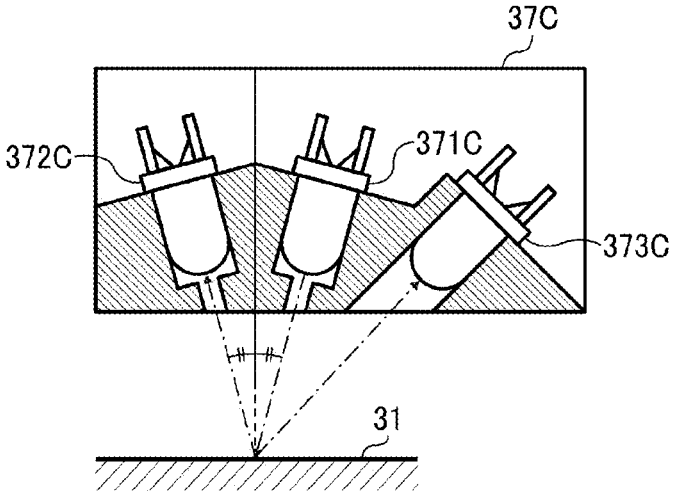
FIG. 5B is a schematic view of another density sensor.

Referring now to FIGS. 5A and 5B, a description is given of the density sensor 37. The density sensor array 37 includes density sensors 37B and 37C.

FIG. 5A is a schematic view of the density sensor 37B serving as a density detector for a black toner image. FIG. 5B is a schematic view of the density sensor 37C serving as a density detector for a color toner image.

As illustrated in FIG. 5A, the density sensor 37B includes a light emitting element 371B such as a light emitting diode (LED) and a light receiving element 372B to receive regular reflection light. The light emitting element 371B emits light onto the intermediate transfer belt 31. The light is reflected by an outer surface of the intermediate transfer belt 31. The light receiving element 372B receives regular reflection light out of the light reflected by the outer surface of the intermediate transfer belt 31.

By contrast, as illustrated in FIG. 5B, the density sensor 37C includes a light emitting element 371C such as a light emitting diode (LED), a light receiving element 372C to receive regular reflection light, and a light receiving element 373C to receive diffused reflection light. Similar to the light emitting element 371B, the light emitting element 371C emits light onto the intermediate transfer belt 31. The light is reflected by the outer surface of the intermediate transfer belt 31. The light receiving element 372C receives regular reflection light out of the light reflected by the outer surface of the intermediate transfer belt 31. The light receiving element 373C receives diffused reflection light out of the light reflected by the outer surface of the intermediate transfer belt 31.

Each of the light emitting elements 371B and 371C is, e.g., an infrared light emitting diode (LED) made of gallium arsenide (GaAs) that emits light having a peak wavelength of about 950 nm. In the present embodiment, each of the light emitting elements 372B, 372C, and 373C is, e.g., a silicon phototransistor having a peak light-receiving sensitivity of about 800 nm. Alternatively, however, the light emitting elements 371B and 371C may have a peak wavelength different from that described above. Similarly, the light receiving elements 372B, 372C, and 373C may have a peak light-receiving sensitivity different from that described above. The density sensor array 37 is disposed about 5 mm away from an object to detect, that is, the outer surface of the intermediate transfer belt 31. Thus, the density sensor array 37 is disposed at a distance of about 5 mm from the outer surface of the intermediate transfer belt 31.

In addition, according to this embodiment, the density sensor array 37 is disposed facing the outer surface of the intermediate transfer belt 31. Alternatively, the density sensor 37B may be disposed facing the photoconductor 1K. Similarly, the density sensor 37C may be disposed facing each of the photoconductors 1Y, 1C, and 1M. Alternatively, the density sensor array 37 may be disposed facing the conveyor belt 36. Output from the density sensor array 37 is transformed to image density or amount of toner attached by a predetermined transformation algorithm.

Figure 6:
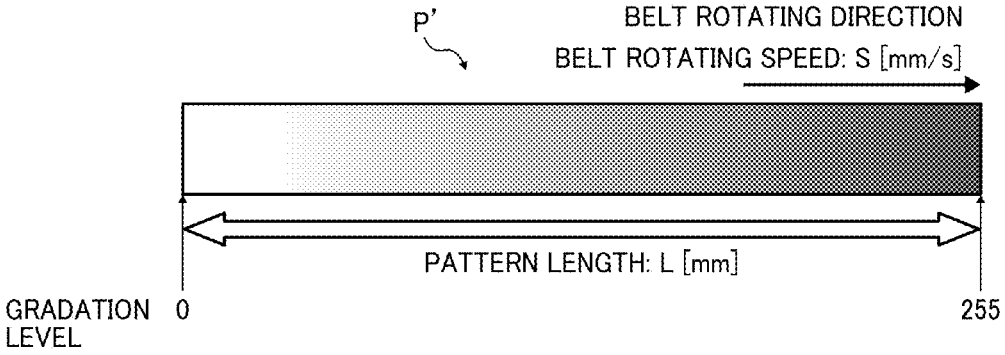
FIG. 6 is a plan view of a continuous gradation pattern according to a comparative example.
Figure 7:
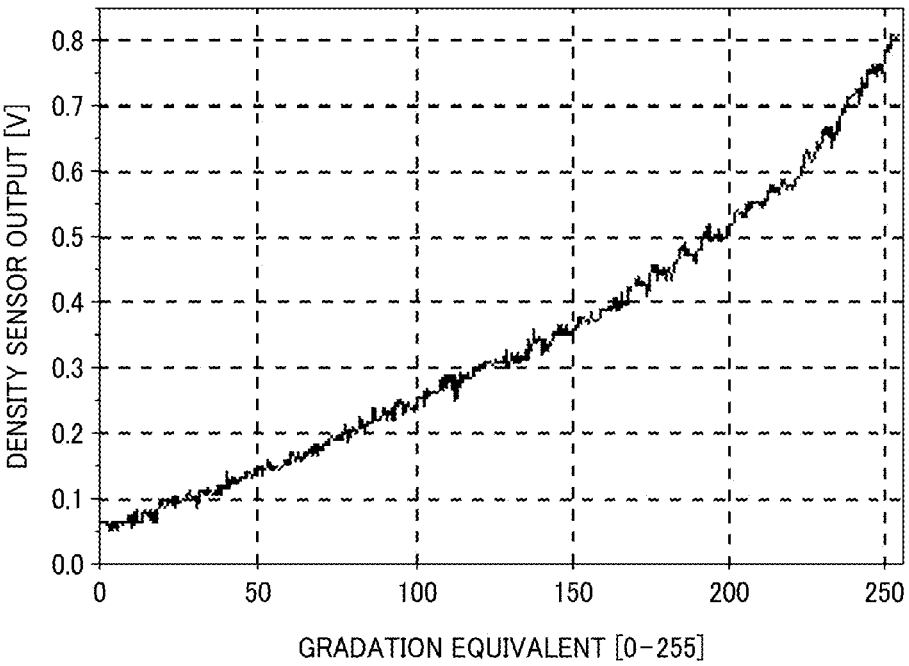
FIG. 7 is a graph of a relation between gradation levels and detected image density of the continuous gradation pattern of FIG. 6.
Figure 8:
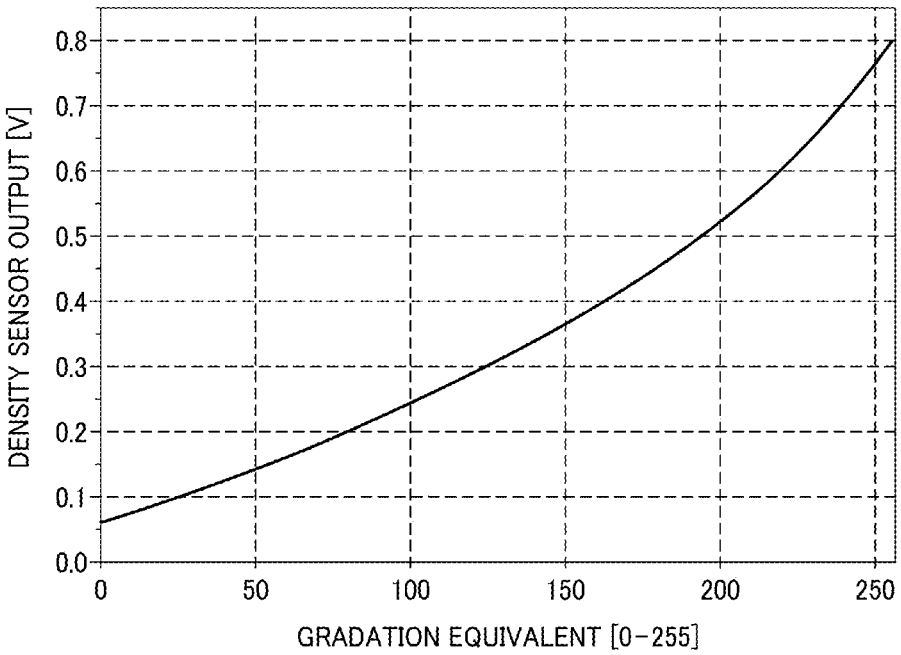
FIG. 8 is a graph of a non-linear function as an approximate function of gradation characteristics determined by using the detected image density of the continuous gradation pattern illustrated in FIG. 7.

Referring now to FIGS. 6 through 8, a description is given of a continuous gradation pattern P' according to a comparative example.

FIG. 6 is a plan view of the gradation pattern P'. The gradation pattern P' includes an imaged portion having 256 gradation levels in total from a minimum gradation level 0 to a maximum gradation level 255, which corresponds to a gradation range of a multi-gradation image that can be formed by the image forming apparatus 600.

The gradation pattern P' is composed of a plurality of patch patterns having the same width (hereinafter referred to as monospaced patch patterns) disposed without a space therebetween in a direction in which an image carrier rotates, that is, the intermediate transfer belt 31 rotates (hereinafter referred to as belt rotating direction). Gradation levels of the plurality of monospaced patch patterns disposed next to each other in the gradation pattern P' equally and continuously increase in the belt rotating direction by, e.g., one gradation level or two gradation levels. Alternatively, the gradation levels of the plurality of monospaced patch patterns disposed next to each other in the gradation pattern P' may equally and continuously decrease in the belt rotating direction by, e.g., one gradation level or two gradation levels.

It is to be noted that L represents a length of the gradation pattern P', S represents a speed at which the intermediate transfer belt 31 rotates (hereinafter referred to as belt rotating speed), and T represents a sampling period of density detection. The gradation level per sampling period can be obtained by a formula of $(256/L)/(S\times T)$. According to the comparative example, L=200 mm, S=440 mm/s, and T=1 ms can be satisfied, for example.

In this example, the maximum gradation level is 255. However, the maximum gradation level can be any level depending on the situation. Preferably, the width of one gradation level of the gradation pattern P' is determined so that the output of the density sensor array 37 does not include a flat portion, that is, the output of the density sensor array 37 is a constant gradation increase rate. Such same gradation increase rate can be achieved when the width of monospaced patch pattern per gradation level is shorter than a detection spot diameter of the density sensor array 37 of, e.g., about 1 mm.

Additionally, in this example, a non-linear function is determined according to the detected image density of the gradation pattern P'. The non-linear function is an approximate function that approximately shows a relation between image density and the plurality of gradation levels in the gradation range used for forming the multi-gradation image.

By using the non-linear function, the gradation characteristic data is generated to correct the gradation of the image data of the image to be outputted. The number of pieces of image density data detected from the gradation pattern P' is at least about twice a number N of unknown parameters of the non-linear function when the approximate function, that is, the non-linear function, is determined. However, if the width of one gradation level of the gradation pattern P' is determined according to the above-described relation between the width of one gradation level of the gradation pattern P' and the detection spot diameter of the density sensor 37, the number of pieces of detected image density data may be lower than the number N of unknown parameters due to such constraints as the belt rotating speed and the sampling period. In such a case, the width of monospaced patch pattern per gradation level may be preferably longer than the detection spot diameter to ensure that the number of pieces of detected image density data is at least twice the number N. Consequently, the gradation increase rate may not be strictly constant. Therefore, an error may be caused during calculation of the gradation levels at the respective positions of the gradation pattern P' at which the density is detected. The error is at most an increased gradation level from one monospaced patch pattern to the adjacent monospaced patch pattern included in the gradation pattern P'. In other words, the error that may be caused during calculation of the gradation levels is the difference of gradation levels between the patch patterns next to each other, that is, the gradation change rate. For example, the gradation change rate is 0 from the moment when the detection spot is completely inserted in a monospaced patch pattern of gradation level N to the moment when the detection spot starts to enter a monospaced patch pattern of gradation level N+1. The gradation level changes from the moment when the detection spot starts to enter the monospaced patch pattern of gradation level N+1 to the moment when the detection spot is completely inserted in the monospaced patch pattern of gradation level N+1. Accordingly, the error that may be caused during calculation of the gradation levels is at most one gradation level. If the monospaced patch patterns are formed every two gradation levels, the error that may be caused during calculation of the gradation levels is at most two gradation levels.

FIG. 7 is a graph of a relation between gradation levels and detected image density of the gradation pattern P' of FIG. 6. In this example, a gradation pattern P' of the color yellow is detected by the density sensor 37C illustrated in FIG. 5B. In FIG. 7, the vertical axis indicates outputs (V) of the density sensor 37C that detects the image density of the gradation pattern P'. The horizontal axis indicates gradation levels (gradation equivalent) calculated according to the gradation levels from 0 to 255 illustrated in FIG. 6. Specifically, a leading end of the gradation pattern P' (left side in FIG. 6) is gradation level 0 while a trailing end of the gradation pattern P' (right side in FIG. 6) is gradation level 255. The gradation pattern P' is detected starting from the leading end to the trailing end. It is to be noted that the leading end is an upstream end of the gradation pattern P' in the belt rotating direction. The trailing end is a downstream end of the gradation pattern P' in the belt rotating direction.

Although the output of the density sensor 37C varies for each gradation level, the image density is detected across the entire gradation levels 0 to 255. The gradation characteristic data that shows the relation between the image density and the gradation levels can be obtained according to detected data of image density.

FIG. 8 is a graph of a non-linear function as an approximate function of gradation characteristics determined by using the detected image density of the gradation pattern P' illustrated in FIG. 7. FIG. 8 illustrates a non-linear function as an approximate function determined by applying quintic approximation to the detected image density data of the gradation pattern P' illustrated in FIG. 7. According to the non-linear function as an approximate function, the gradation characteristic data can be obtained that shows the relation between image density levels and entire gradation levels (0 to 255) in the gradation range used for correcting the gradation upon multi-gradation image formation. The gradation characteristic data may be referred to as a gradation correction table or gradation conversion table.

The gradation correction after obtaining the gradation characteristic data can be performed by a known way. For example, upon multi-gradation image formation, gradation correction (γ conversion) is performed on the image data of the image to be outputted by using the gradation characteristic data to obtain a target image density, that is, target gradation characteristics, for each gradation level.

At the y-intercept in FIG. 8, the gradation level is 0, which is a gradation level of a background area without toner attached thereto. An accurate output level of the density sensor 37C relative to the background area can be obtained by detecting an area without toner. Specifically, the exposed surface of the intermediate transfer belt 31 is detected by the density sensor 37C in advance. By fixing the detected level to the y-intercept and applying a least-squares approach, approximation can be executed with higher accuracy. Accordingly, an accurate approximate function (non-linear function) can be achieved.

Referring now to FIGS. 9 to 14, a description is given of a gradation pattern P serving as a gradation correction pattern according to an embodiment of this disclosure.

Figure 9:
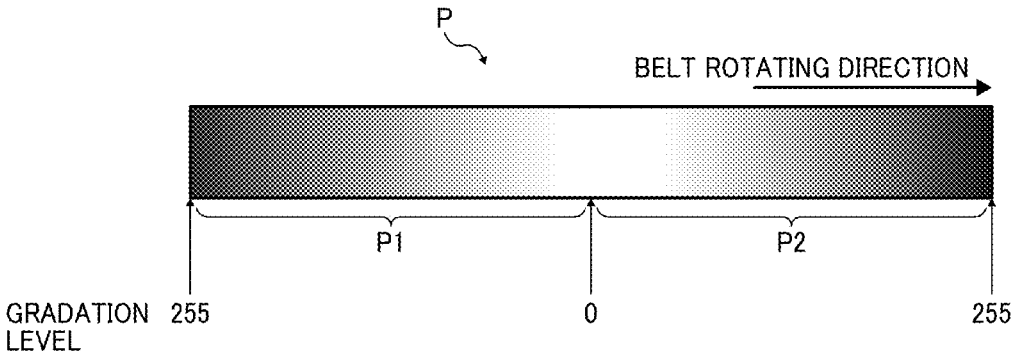
FIG. 9 is a plan view of a gradation pattern according to an embodiment of this disclosure.

FIG. 9 is a plan view of the gradation pattern P. As illustrated in FIG. 9, the gradation pattern P includes two gradation patterns, that is, a first pattern P1 (first half) of gradation levels 255 to 0 and a second pattern P2 (second half) of gradation levels 0 to 255 continuous with the first pattern P1, disposed in the belt rotating direction. The first pattern P1 includes gradations levels changing continuously from the maximum gradation level 255 to the minimum gradation level 0. The second pattern P2 includes gradations levels changing continuously from the minimum gradation level 0 to the maximum gradation level 255. The gradation pattern P of this embodiment is a combination of two gradation patterns P' illustrated in FIG. 6. The first pattern P1 (first half) and the second pattern P2 (second half) of the gradation pattern P have identical lengths in the belt rotating direction.

Gradation levels for each of a plurality of positions of the gradation pattern P at which image density is detected can be calculated as in the comparative example illustrated in FIGS. 6 through 8. Alternatively, the gradation levels may be calculated by a calculation approach different from that employed in the case of the comparative example. In other words, according to this embodiment, a start position and an end position of the gradation pattern P can be identified by the difference of output levels of the density sensor array 37 at each end of the gradation pattern P. For example, the time when detecting position is changed from a background area of the intermediate transfer belt 31 to an adjacent leading end of the first pattern P1 is defined as a start time of the gradation pattern P. Similarly, the time when detecting position is changed from a trailing end of the second pattern P2 to an adjacent background area of the intermediate transfer belt 31 is defined as an end time of the gradation pattern P. A time difference between the start time and the end time of the gradation pattern P corresponds to the entire length of the gradation pattern P. Gradation level 255 is a gradation level at each of the start position and the end position of the gradation pattern P identified as described above. The gradation change rate can be obtained according to the time difference and the entire gradation levels of the gradation pattern P (e.g., 512 gradation levels=256 gradation levels×2). The gradation change rate is a change rate of gradation levels per unit time. Accordingly, the gradation levels at the respective positions of the gradation pattern P at which image density is detected can be calculated according to information of the gradation change rate and the time when the image density is detected at the respective positions of the gradation pattern P. In such a case, the calculation of the gradation levels obviates information of the speed at which the intermediate transfer belt 31 rotates and information of the length of the gradation pattern P.

Figure 10:
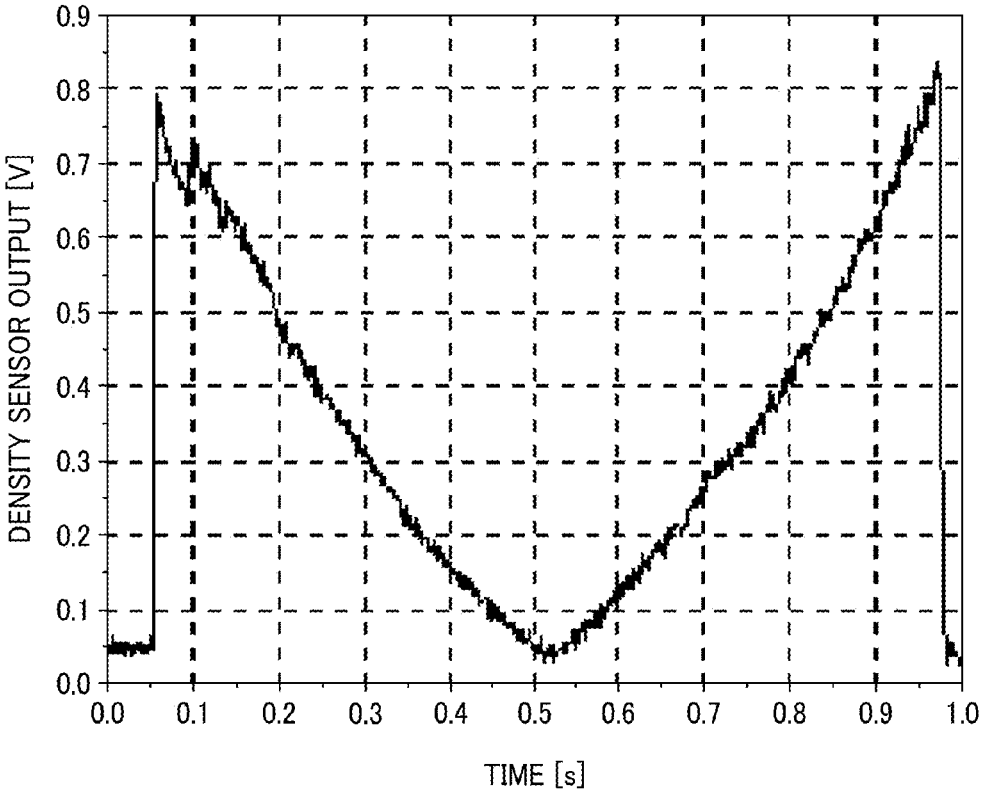
FIG. 10 is a graph of detected image density of the gradation pattern of FIG. 9, illustrating transition of the detected image density over time.

FIG. 10 is a graph of detected image density of the gradation pattern P of FIG. 9, illustrating transition of the detected image density over time. In this example, a gradation pattern P of the color magenta is detected by the density sensor 37C illustrated in FIG. 5B. In FIG. 10, the vertical axis indicates outputs (V) of the density sensor 37C that detects the image density of the gradation pattern P.

Data at 0.0 second and data at 1.0 second are image density data detected relative to a background area of the intermediate transfer belt 31, without a pattern formed therein. The output level of the density sensor 37C relative to the background area is lower than the output level of the density sensor 37C relative to the gradation pattern P. By contrast, data from about 0.05 second to about 0.96 second is image density data detected relative to the area of the gradation pattern P. An output level of the density sensor 37C at about 0.05 second and that at about 0.96 second are the maximum levels in the first pattern P1 (first half) and the second pattern P2 (second half). A leading end of the gradation pattern P has the maximum level in the first pattern P1. A trailing end of the gradation pattern P has the maximum level in the second pattern P2. The output level of the density sensor 37C relative to the leading end of the gradation pattern P, which is a solid image area, can be identified by the difference from the output level of the density sensor 37C relative to the adjacent background area. Similarly, the output level of the density sensor 37C relative to the trailing end of the gradation pattern P, which is a solid image area, can be identified by the difference from the output level of the density sensor 37C relative to the adjacent background area. Accordingly, the respective output levels of the density sensor 37C relative to the leading end and the trailing end of the gradation pattern P can be easily identified with an appropriate threshold.

The threshold can be determined by any appropriate approach. For example, a range in which the output level of the density sensor 37C relative to the background areas varies may be clarified in advance and the threshold is set to a level outside the range. In another example, the threshold is set to a level approximately twice the output level of the density sensor 37C relative to the background areas as a level which the output level of the density sensor 37C relative to the background areas does not reach, because an increased output level of the density sensor 37C relative to the background areas leads to an increased output level of the density sensor 37C relative to the gradation pattern P.

In FIG. 10, an output level of the density sensor of 0.3 v is determined as a threshold which the output level of the density sensor 37C relative to the background areas does not reach. Accordingly, the time at the start position of the gradation pattern P and the time at the end position of gradation pattern P are identified. Since gradation level 0 is a middle gradation level of the gradation pattern P, the output level of the density sensor 37C relative to the gradation pattern P decreases to the output level of the density sensor 37C relative to the background areas (hereinafter referred to as background area level) in the middle. The decrease to the background area level is known from the layout of the gradation pattern P. Accordingly, the time when the output level of the density sensor 37C relative to the gradation pattern P decreases to the background area level is not erroneously recognized as the time at the end position of the gradation pattern P. For example, a predetermined flag is set after the start position of the gradation pattern P is detected. Then, the flag is removed when the output level of the density sensor 37C relative to the gradation pattern P shifts across the threshold twice. Finally, the end position of the gradation pattern P is identified. With such an approach, the end position and time of the gradation pattern P can be easily prevented from being erroneously recognized.

Figure 11:
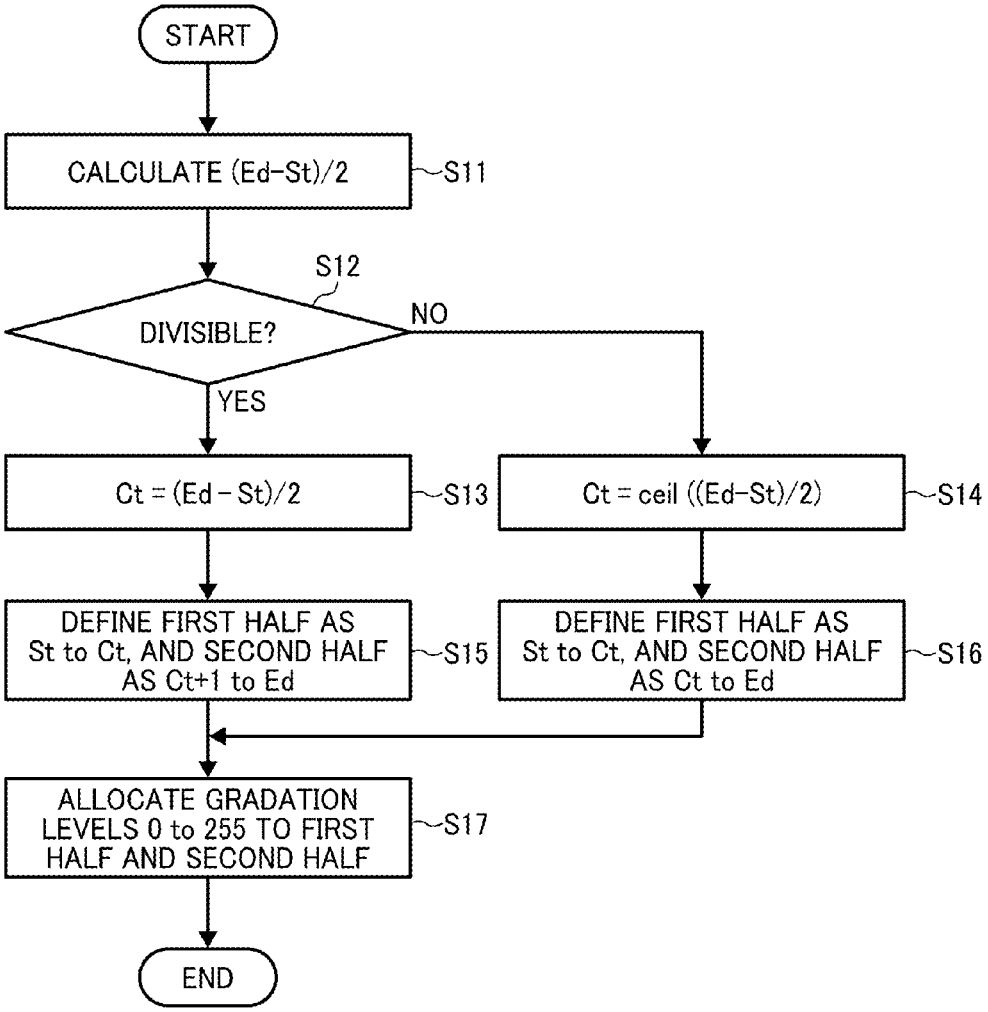
FIG. 11 is a flowchart of an algorithm for allocating gradation levels to individual positions of the gradation pattern of FIG. 9 at which image density is detected.

FIG. 11 is a flowchart of an algorithm for allocating gradation levels to individual positions of the gradation pattern P of FIG. 9 at which image density is detected. After the start position and the end position of the gradation pattern P are identified, sample numbers are given to each of image density data detected at the start position and the end position of the gradation pattern P thus identified. Here, a sample number St represents the image density data detected at the start position of the gradation pattern P. Similarly, a sample number Ed represents the image density data detected at the end position of the gradation pattern P. FIG. 11 illustrates a flowchart of converting the sample numbers to gradation levels.

In FIG. 11, a sample number Ct in the middle of the gradation pattern P is calculated in steps S11 through S14. It is to be noted that "ceil" of step S14 is an operator for rounding up a value. Firstly, a formula of (Ed−St)/2 is calculated (step S11).

If the formula of (Ed−St)/2 is divisible (yes in step S12), then a formula of Ct=(Ed−St)/2 is satisfied (step S13), and the detected image density data of the gradation pattern P is divided into the first half and the second half (step S15). On the other hand, if the formula of (Ed−St)/2 is not divisible (no in step S12), then it is determined that Ct, which is gradation level 0, exists at only one point, and a formula of Ct=ceil ((Ed−St)/2) is satisfied (step S14). Accordingly, Ct is included in both the first half and the second half of the gradation pattern P when the detected image density data of the gradation pattern P is divided into the first half and the second half (step S16). Lastly, gradation levels 0 to 255 are allocated to each detected piece of image density data in the first half and the second half of the gradation pattern P by utilizing the change of gradation level obtained by a formula of 256/(Ct−St) between adjacent detected pieces of image density data in each of the first half and the second half of the gradation pattern P (step S17).

Figure 12:
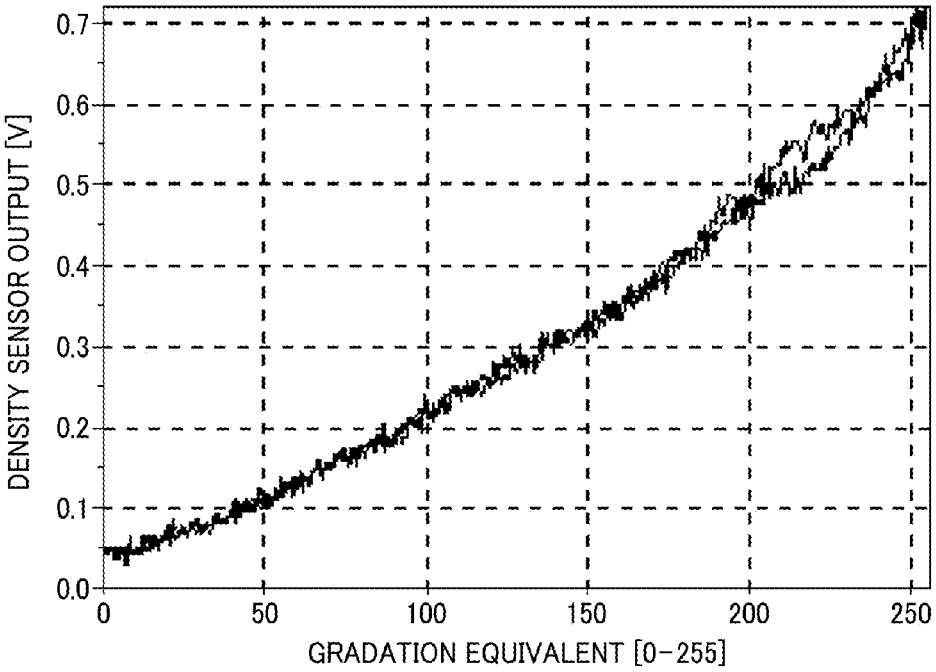
FIG. 12 is a graph of a relation between detected image density and gradation levels of the gradation pattern of FIG. 9.

FIG. 12 is a graph of a relation between detected image density and gradation levels of the gradation pattern P of FIG. 9. In this example, a gradation pattern P of the color yellow is detected by the density sensor 37C illustrated in FIG. 5B. In FIG. 12, the vertical axis indicates output of the density sensor 37C that detects image density of the gradation pattern P. The horizontal axis indicates gradation levels (gradation equivalent) calculated by an algorithm of FIG. 11, with gradation level 255 at a leading end of the gradation pattern P (left side in FIG. 9) and at a trailing end of the gradation pattern P (right side in FIG. 9), and gradation level 0 in the middle. It is to be noted that the leading end is an upstream end of the gradation pattern P in the belt rotating direction. The trailing end is a downstream end of the gradation pattern P in the belt rotating direction. In other words, FIG. 12 illustrates a detection result of the gradation pattern P obtained by the flowchart of FIG. 11 for allocating the gradation levels to the detected image density illustrated in FIG. 10. In FIG. 12, one line shows detected image density data in the first pattern P1 (first half) of the gradation pattern P. The other line shows detected image density data in the second pattern P2 (second half) of the gradation pattern P. Approximation of all the detected pieces of image density data in the first pattern P1 and the second pattern P2 of the gradation pattern P is executed by applying the least-squares approach. Accordingly, a non-linear function is determined as an approximate function that approximately shows the relation between image density and the plurality of gradation levels in the gradation range used for forming the multi-gradation image.

Figure 13:
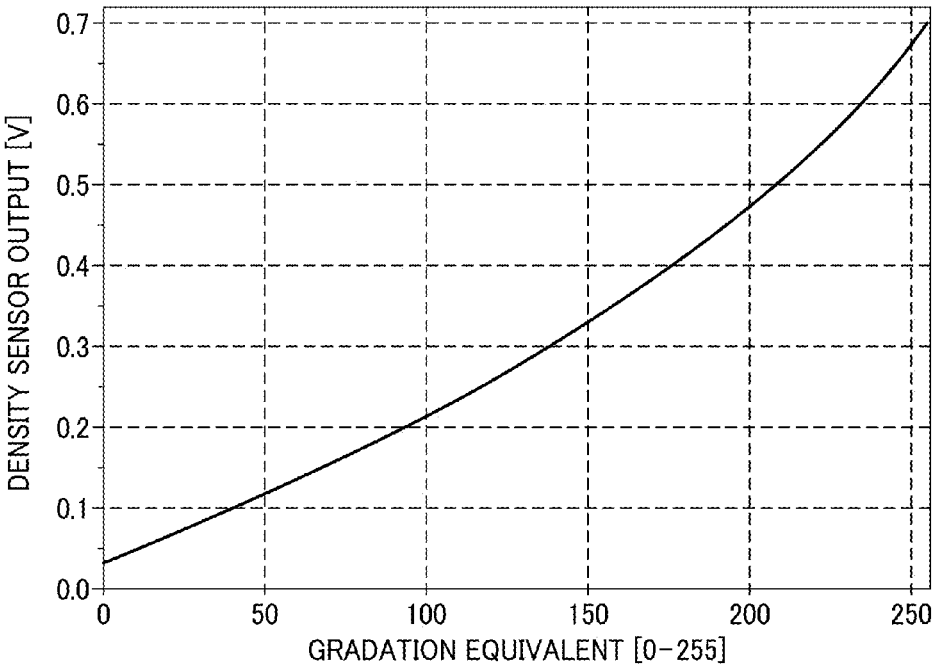
FIG. 13 is a graph of a non-linear function as an approximate function of gradation characteristics determined by using the detected image density of the gradation pattern illustrated in FIG. 12.

FIG. 13 is a graph of the non-linear function as an approximate function of gradation characteristics determined by using the detected image density of the gradation pattern P illustrated in FIG. 12. FIG. 13 illustrates the non-linear function as an approximate function achieved by applying quintic approximation to the detected image density data of FIG. 12 as in the comparative example described above. According to the non-linear function as an approximate function, the gradation characteristic data (gradation correction table or gradation conversion table) can be obtained that shows the relation between image density levels and entire gradation levels (0 to 255) in the gradation range used for correcting the gradation upon multi-gradation image formation.

The gradation correction after obtaining the gradation characteristic data can be performed by a known way. For example, upon multi-gradation image formation, gradation correction (γ conversion) is performed on the image data of the image to be outputted by using the gradation characteristic data to obtain a target image density, that is, target gradation characteristics, for each gradation level.

At the y-intercept in FIG. 13, the gradation level is 0, which is a gradation level of a background area without toner attached thereto. An accurate output level of the density sensor 37C relative to the background area can be obtained by detecting an area without toner. In other words, an exposed surface of the intermediate transfer belt 31 is detected by the density sensor 37C in advance. By fixing the detected level to the y-intercept and applying the least-squares approach, approximation can be executed with higher accuracy. Accordingly, an accurate approximate function (non-linear function) can be achieved.

Figure 14:
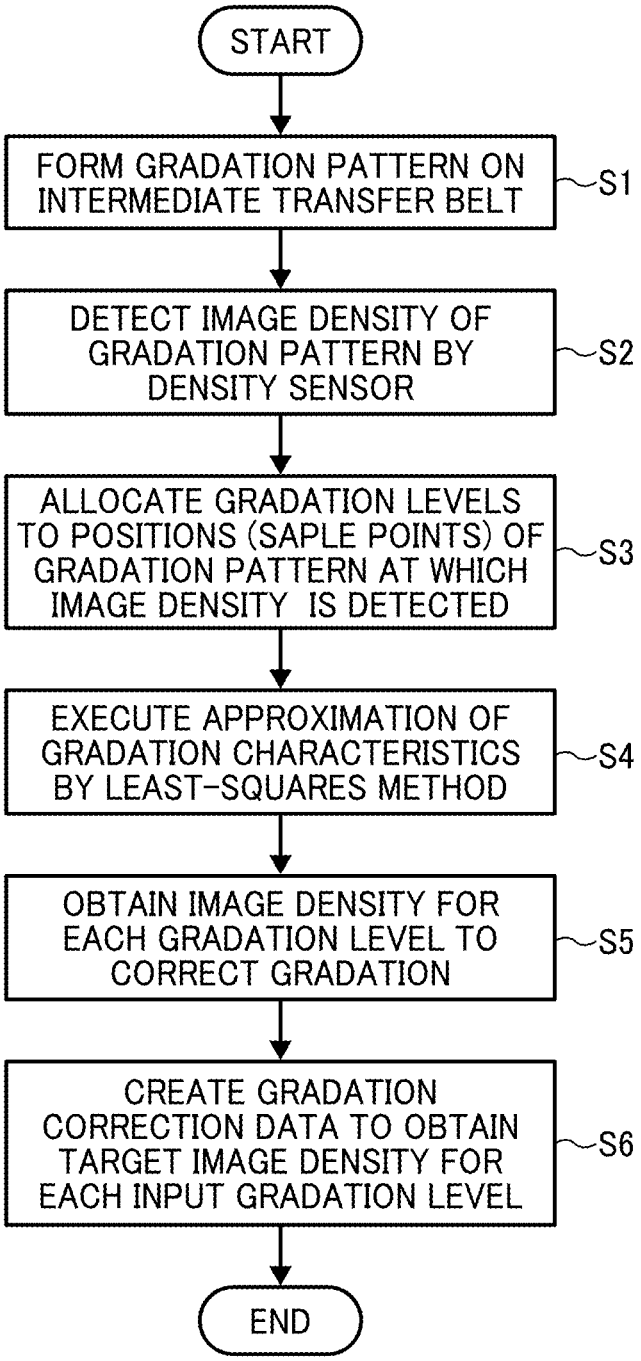
FIG. 14 is a flowchart of a process of generating gradation characteristic data in the image forming apparatus of FIG. 1.

FIG. 14 is a flowchart of a process of generating gradation characteristic data in the image forming apparatus 600.

In FIG. 14, firstly, the gradation pattern P of FIG. 9 is formed on the intermediate transfer belt 31 (step S1). Then, the density sensor 37C detects the image density of the gradation pattern P formed on the intermediate transfer belt 31 (step S2). Then, according to the flow illustrated in FIG. 11, the gradation levels are allocated to individual positions (sample points) of the gradation pattern P at which image density is detected (step S3). Then, approximation of the gradation characteristics is executed by the non-linear function, using the least-squares approach, with the gradation levels as input and the output level of the density sensor 37C as output (step S4). Then, the image density for each of the gradation levels 0 to 255 is obtained to correct gradation, by inputting each of the gradation levels 0 to 255 to the non-linear function (approximation formula) (step S5). Then, the gradation correction data (gradation correction table or gradation conversion table) is generated to obtain a target image density, that is, target gradation characteristics, for each gradation level inputted (step S6).

According to the above-described embodiment, a gradation pattern (e.g., gradation pattern P') is used as a gradation correction pattern. The gradation pattern is composed of a plurality of monospaced patch patterns disposed without a space therebetween in the belt rotating direction. Gradation levels evenly increase or decrease in the belt rotating direction from one monospaced patch pattern to an adjacent monospaced patch pattern. For example, the gradation level of one monospaced patch pattern increases or decreases to the gradation level of the adjacent monospaced patch pattern by one gradation level. Alternatively, the gradation level of one monospaced patch pattern increases or decreases to the gradation level of the adjacent monospaced patch pattern by two gradation levels. The gradation pattern including such a plurality of monospaced patch patterns disposed at equal intervals is formed on the intermediate transfer belt 31 that rotates at a predetermined speed. The image density of the gradation pattern is detected on the intermediate transfer belt 31. Accordingly, the image density is detected at each position corresponding to each gradation level. For example, when gradation levels 0 to 100 are allocated to a gradation pattern having a length of 10 mm, the gradation level increases by 10 gradation levels per 1 mm of the gradation pattern. The image density of the gradation pattern is sampled and detected at a predetermined time interval. Accordingly, sampling positions at which image density is detected exist at a predetermined interval. For example, when gradation levels 0 to 100 are allocated to a gradation pattern having a length of 10 mm and 1000 samples are taken from the gradation pattern, the gradation level increases by 0.1 gradation level per sample.

It is to be noted that "variation" as a noise component existing in the image density data detected from the gradation pattern may be caused by combined factors such as noise of the density sensor 37, deformation of the intermediate transfer belt 31, and uneven density within the gradation pattern. Therefore, the "variation" as a noise component existing in the image density data detected from the gradation pattern can be regarded as Gaussian white noise. Accordingly, by executing approximation of a large amount of pieces of detected image density data including the "variation" by a non-linear function (e.g., n-degree polynomial), smooth and accurate fitting can be achieved to generate accurate gradation correction data. Instead of a typical way of accurately detecting density for a gradation level, rough image density data is detected for a plurality of gradation levels according to the above-described embodiment. Accordingly, the density for all the gradation levels used for forming the multi-gradation image can be accurately corrected.

According to the above-described embodiment, gradation level 255 is the maximum gradation level in the gradation correction data (gradation correction table or gradation conversion table), but is not limited thereto. The maximum gradation level in the gradation correction data may be set according to a maximum gradation level in a gradation range used for forming a multi-gradation image by using the gradation correction data.

In addition, according to the above-described embodiment, the gradation pattern P is formed on the intermediate transfer belt 31. Alternatively, the gradation pattern P may be formed on another image carrier such as a photoconductor (e.g., photoconductor 1Y) or a conveyor belt (e.g., conveyor belt 36) that conveys a recording medium.

Moreover, according to the above-described embodiment, the gradation pattern P includes the first pattern P1 and the second pattern P2 having identical lengths in the belt rotating direction. Alternatively, a gradation pattern having a different configuration may be used. For example, a gradation pattern including a first pattern P1 and a second pattern P2 having different lengths in the belt rotating direction may be used.

The above-description is given of an embodiment of this disclosure. This disclosure provides effects specific to the individual aspects described below.

According to a first aspect of this disclosure, there is provided an image forming apparatus (e.g., image forming apparatus 600), which includes an image carrier (e.g., intermediate transfer belt 31), an image forming unit (e.g., image forming unit 100), a density detector (e.g., density sensor 37C), a gradation characteristic data generator (e.g., controller 611), and a gradation corrector (e.g., color/gradation correction unit 604). The image carrier rotates at a predetermined speed and is capable of carrying an image on a surface thereof. The image forming unit is capable of forming a multi-gradation image on the image carrier. The density detector detects density of the multi-gradation image formed on the image carrier. The gradation characteristic data generator forms a gradation correction pattern (e.g., gradation pattern P) on the image carrier via the image forming unit and detects image density of the gradation correction pattern via the density detector to generate gradation characteristic data that shows a relation between the image density and a plurality of gradation levels in a gradation range used for forming the multi-gradation image according to a detected image density of the gradation correction pattern. The gradation corrector corrects image data of the multi-gradation image to be outputted, according to the gradation characteristic data. The gradation correction pattern is a continuous gradation pattern including a first pattern (e.g., first pattern P1) and a second pattern (e.g., second pattern P2). In the first pattern, gradation levels change continuously from a maximum gradation level to a minimum gradation level in the gradation range. In the second pattern, gradation levels change continuously from the minimum gradation level to the maximum gradation level in the gradation range. The second pattern is continuous with the first pattern in a direction in which the image carrier rotates.

The gradation characteristic data generator continuously detects image density of the continuous gradation pattern formed on the image carrier and image density of background areas next to an upstream end and a downstream end of the gradation correction pattern, respectively, in the direction in which the image carrier rotates, in a predetermined sampling period, via the density detector, to generate the gradation characteristic data according to detected image density of the continuous gradation pattern and image density of the background areas.

With such a configuration, as described above, the image density is continuously detected from the background area of the image carrier in which the continuous gradation pattern is not formed to the adjacent upstream end of the continuous gradation pattern (i.e., gradation correction pattern), having the maximum gradation level, in the direction in which the image carrier rotates. On a boundary between the background area and the adjacent upstream end of the continuous gradation pattern, the detected image density significantly increases. Accordingly, a start position of the continuous gradation pattern can be accurately detected. Similarly, the image density is continuously detected from the downstream end of the continuous gradation pattern (i.e., gradation correction pattern), having the maximum gradation level, in the direction in which the image carrier rotates, to the adjacent background area of the image carrier in which the continuous gradation pattern is not formed. On a boundary between the downstream end of the continuous gradation pattern and the adjacent background area, the detected image density significantly decreases. Accordingly, an end position of the continuous gradation pattern can be accurately detected. Thus, the start position and the end position of the continuous gradation pattern can be accurately detected even if the speed at which the image carrier rotates varies and/or the length of the continuous gradation pattern varies. In addition, distribution of the gradation levels in the continuous gradation pattern is known. Accordingly, gradation levels at respective positions of the continuous gradation pattern at which image density is detected can be accurately calculated.

Moreover, between the upstream end and the downstream end of the continuous gradation pattern in which image density is continuously detected, gradation levels change from the maximum gradation level to the minimum gradation level in the gradation range used for forming the multi-gradation image. Accordingly, image density can be detected for each gradation levels changing continuously across the gradation range.

As described above, the gradation levels at the respective positions of the continuous gradation pattern at which image density is detected can be accurately calculated even if the speed at which the image carrier rotates varies and/or the length of the continuous gradation pattern varies. In addition, image density can be detected for each gradation levels changing continuously across the gradation range of the continuous gradation pattern. Accordingly, the gradation characteristic data can be accurately generated that shows the relation between image density and gradation levels without being affected by variation in the speed at which the image carrier rotates and/or variation in the length of the continuous gradation pattern.

According to a second aspect of this disclosure, the gradation characteristic data generator determines an approximation function that approximately shows the relation between the image density and the plurality of gradation levels in the gradation range used for forming the multi-gradation image, according to the detected image density of the continuous gradation pattern. The gradation characteristic data generator then generates the gradation characteristic data by using the approximation function.

With such a configuration, as described above, determination of the approximation function that approximately shows the image density and the plurality of the gradation levels can reduce influence of variation in the image density detected at the respective positions of the continuous gradation pattern caused by e.g., noise. In addition, use of the approximation function allows detection of image density for a gradation level other than a gradation level at a position of the continuous gradation pattern at which the image density is detected. Accordingly, the gradation characteristic data can be accurately generated that shows the relation between the image density and the gradation levels without increasing the number of positions of the continuous gradation pattern at which the image density is detected.

According to a third aspect of this disclosure, the detected image density of the background areas of the image carrier is used as image density when a gradation level used for determining the approximation function is 0.

With such a configuration, as described above, the image density for gradation level 0 can be accurately detected. Accordingly, the image density on lower gradation-level side can be stabilized, and thus accurately detected, in the approximation function.

According to a fourth aspect of this disclosure, the gradation characteristic data generator calculates a gradation level at each of a plurality of positions of the continuous gradation pattern at which the image density is detected, according to a start time when detection is changed from a background area of the image carrier to an adjacent leading end of the first pattern of the continuous gradation pattern and an end time when detection is changed from a trailing end of the second pattern of the continuous gradation pattern to an adjacent background area of the image carrier. The start time and the end time are determined according to the image density detected by the density detector.

With such a configuration, as described above, gradation levels of the continuous gradation pattern at the respective positions at which image density is detected can be accurately calculated according to an output of a clock.

According to a fifth aspect of this disclosure, the continuous gradation pattern has a length per gradation level in the direction in which the image carrier rotates shorter than a detection spot diameter of the density detector.

With such a configuration, as described above, gradation levels of the continuous gradation pattern at the respective positions at which image density is detected monotonically change, with an even change rate across the continuous gradation pattern. Accordingly, the accuracy of the approximation function increases.

According to a sixth aspect of this disclosure, the first pattern and the second pattern of the continuous gradation pattern have identical lengths in the direction in which the image carrier rotates.

With such a configuration, as described above, image density at a gradation level in the first pattern of the continuous gradation pattern can be detected concurrently with image density at the same gradation level in the second pattern of the continuous gradation pattern. This ensures reduction of the influence of variation in the image density detected at the respective positions of the continuous gradation pattern caused by e.g., noise.

According to a seventh aspect of this disclosure, the first pattern and the second pattern of the continuous gradation pattern have different lengths in the direction in which the image carrier rotates.

With such a configuration, as described above, image density can be detected for different gradation levels in the first pattern and the second pattern of the continuous gradation pattern. The number of the gradation levels at the respective positions of the continuous gradation pattern at which image density is detected increases, and sufficient image density data for the gradation levels can be obtained. Accordingly, the gradation characteristic data can be accurately generated. The approximation function can be accurately determined.

The present invention, although it has been described above with reference to specific exemplary embodiments, is not limited to the details of the embodiments described above, and various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. An image forming apparatus comprising:

an image carrier rotatable at a predetermined speed to carry an image on a surface thereof;

an image forming unit to form a multi-gradation image on the image carrier;

a density detector to detect density of the multi-gradation image formed on the image carrier;

a gradation characteristic data generator to form a gradation correction pattern on the image carrier via the image forming unit, to detect image density of the gradation correction pattern via the density detector, and to generate gradation characteristic data that shows a relation between the image density and a plurality of gradation levels in a gradation range used for forming the multi-gradation image according to a detected image density of the gradation correction pattern; and a gradation corrector to correct image data of the multi-gradation image to be outputted, according to the gradation characteristic data, the gradation correction pattern being a continuous gradation pattern including:

a first pattern having gradation levels changing continuously from a maximum gradation level to a minimum gradation level in the gradation range; and a second pattern having gradation levels changing continuously from the minimum gradation level to the maximum gradation level in the gradation range, the second pattern continuous with the first pattern in a direction in which the image carrier rotates, the gradation characteristic data generator continuously detecting image density of the continuous gradation pattern formed on the image carrier and image density of background areas next to an upstream end and a downstream end of the gradation correction pattern, respectively, in the direction in which the image carrier rotates, in a predetermined sampling period, via the density detector, to generate the gradation characteristic data according to detected image density of the continuous gradation pattern and image density of the background areas.

2. The image forming apparatus according to claim 1, wherein the gradation characteristic data generator determines an approximation function that approximately shows the relation between the image density and the plurality of gradation levels in the gradation range used for forming the multi-gradation image, according to the detected image density of the continuous gradation pattern, to generate the gradation characteristic data by using the approximation function.

3. The image forming apparatus according to claim 2, wherein the detected image density of the background areas of the image carrier is used as image density when a gradation level used for determining the approximation function is 0.

4. The image forming apparatus according to claim 1, wherein the gradation characteristic data generator calculates a gradation level at each of a plurality of positions of the continuous gradation pattern at which the image density is detected, according to a start time when detection is changed from a background area of the image carrier to an adjacent leading end of the first pattern of the continuous gradation pattern and an end time when detection is changed from a trailing end of the second pattern of the continuous gradation pattern to an adjacent background area of the image carrier, wherein the start time and the end time are determined according to the image density detected by the density detector.

5. The image forming apparatus according to claim 1, wherein the continuous gradation pattern has a length per gradation level in the direction in which the image carrier rotates shorter than a detection spot diameter of the density detector.

6. The image forming apparatus according to claim 1, wherein the first pattern of the continuous gradation pattern and the second pattern of the continuous gradation pattern have identical lengths in the direction in which the image carrier rotates.

7. The image forming apparatus according to claim 1, wherein the first pattern of the continuous gradation pattern and the second pattern of the continuous gradation pattern have different lengths in the direction in which the image carrier rotates.

* * * * *